United States Patent [19]

Stock

[11] 3,940,232

[45] Feb. 24, 1976

[54] APPARATUS FOR MAKING ICE CUBES OR THE LIKE

[76] Inventor: Malcolm D. Stock, 93 Douglas Road, Staten Island, N.Y. 10304

[22] Filed: Apr. 1, 1974

[21] Appl. No.: 456,639

[52] U.S. Cl. ..... 425/447; 62/60; 62/356; 62/530; 249/112

[51] Int. Cl.[2] ..... A01J 25/12

[58] Field of Search ..... 62/530, 60, 72, 356; 249/112, 121, 127, 130; 425/447

[56] References Cited

UNITED STATES PATENTS

| | | | |
|---|---|---|---|
| 404,703 | 6/1889 | Hall | 249/112 X |
| 2,771,749 | 11/1956 | Miller | 62/356 X |
| 2,964,920 | 12/1960 | Staebler | 62/60 |
| 2,966,041 | 12/1960 | Zearfoss, Jr. et al. | 62/60 |
| 2,980,248 | 4/1961 | Embring | 249/121 |
| 3,120,112 | 2/1964 | Davis | 249/130 X |

*Primary Examiner*—William E. Wayner
*Assistant Examiner*—William E. Tapolcai, Jr.
*Attorney, Agent, or Firm*—Kirschstein, Kirschstein, Ottinger & Frank

[57] ABSTRACT

An apparatus for forming ice cubes mold means are provided having walls that define a plurality of separate cavities. A resilient, pliable empty bag is brought into engagement in a mold to be frozen and is placed in contact with the mold means. Preferably the mold means is comprised of two mold sections between which is sandwiched the liquid pliable package which because of its inherent resiliency and pliability the liquid filled package conforms to the shape of the cavities in the mold means. Passageways are provided that interconnect adjacent ones of the cavities so that the resulting frozen articles are connected to each other by readily frangible sections. In one form of the invention a reservoir is provided for containing the liquid to be frozen as well as a plurality of conduit means that are used for filling a number of the pliable packages positioned within the mold means. The reservoir may include a float that cooperates with a water inlet supply valve so as to maintain the liquid in the reservoir at a predetermined level. The reservoir is elevated with respect to the pliable packages and the mold means so that the water fills the packages by gravity feed.

3 Claims, 12 Drawing Figures

26
22
24
16
3a
14
38
36
44
40
42
5
48
50
45
43
12'
38'
40'
42'
44'
12a
12b
12c
12d

APPARATUS FOR MAKING ICE CUBES OR THE LIKE

BACKGROUND OF THE INVENTION

1. Field of the Search

This invention relates generally to the refrigeration arts and more particularly to commercial apparatus for forming ice cubes, block ice or the like.

2. Description of the Prior Art

The most common form of structure used for forming ice cubes or the like is an open metal tray in which is positioned a removable grid. The tray is filled with water and, with the grid in place, is subjected to a reduction in temperature that causes the water to freeze and thereby form cubes that conform to the grid structure. While this form of prior art is in general use it does exhibit several shortcomings. First of all it is frequently difficult to remove the ice cubes and to accomplish this it is often necessary to provide complex and costly structure that is frequently subject to malfunction. In addition, the metal tray must be filled at a sink and then transported to the freezer compartment of a refrigerator and in the process the water is frequently spilled.

Commercially large scale manufacturers of block ice form large blocks in the normal fashion and then the blocks are cut into smaller cubes which are then in turn handled by loaders and placed into plastic bags of predetermined weights. The plastic bags are generally tied or stapled closed. These plastic bags are thereafter transferred to large insulated bags weighing approximately forty (40) pounds in order to facilitate their storage and handling. The commercial process outlined requires people to handle the cubes for bagging and distribution to the final vendor. The process outlined also exposes the water or ice block to contaminants during the handling and further increases the risk of the melting of the ice cubes during storage and transporting periods. Even a partial melting and a later refreezing will create substantial inconveniences for the ultimate consumer and also those handling the bags of cubes. Further, excessive handling by individuals either in loading cubes into the bag or handling the bag after it has been loaded creates the punctures in the bag which results in contamination of the cubes. All of these contribute to the failure of the prior art to furnish a satisfactory commercial method and apparatus for producing ice cubes under complete sanitary conditions.

In order to overcome these and other objections to the prior art a somewhat different approach has been taken such as disclosed in U.S. Pat. Nos. 2,964,920 and 2,966,041. In the aforementioned United States Patents a pliable package is positioned between a pair of hingedly connected grid-like members which, in their closed condition, compress the package and displace the water therein so as to form discrete cube-like columns. The package, together with grid-like structure is then placed in the freezer compartment of a refrigerator and the liquid therein is then frozen.

While the issued United States patents do represent a substantial improvement over the open metal tray form of prior art they too exhibit their own disadvantages. For example, the prior art devices described in the aforementioned patents do not conveniently lend themselves to rapid filling of a large number of packages. Another disadvantage of these prior art devices is that the packages are subject to contamination during the filling process. Still another disadvantage of the patented prior art devices is the relatively weak construction of the grid-like members. It will be readily appreciated that when the grid-like structures are closed considerable pressure must be applied to the pliable package and there is the ever present likelihood of rupturing the package. Moreover, because the patented prior art mentioned above utilizes a grid-like structure, the volume of the resultant ice cubes cannot be closely controlled. It is an unmeasured quantity and distortion of the package and cubes.

SUMMARY OF THE INVENTION

Purposes of the Invention

It is a general object of the present invention to avoid and overcome the foregoing and other difficulties with prior art ice cube making structures.

An object of the present invention is to provide apparatus for commercially producing ice cubes in closed packages at relatively high rates of speed.

Another object of the present invention is to provide apparatus for producing ice cubes already packaged.

A further object of the present invention is to provide for the formation of ice cubes within a bag under completely controlled sanitary conditions.

Still a further object of the present invention is to provide a means for delivering measured quantities of water to a bag so that uniform numbers of ice cubes can be frozen simultaneously in different bags.

A further object of the present invention is to provide for the forming of ice cubes wherein the bag which is filled with a liquid is only handled in a frozen condition.

Another object of the present invention is to provide a system of filling bags to form ice cubes and avoid the formation of air pockets.

A primary object of the present invention is to provide ice cubes in a closed clean system which requires minimum handling.

Another object of the present invention is to provide an improved ice cube forming structure that is capable of producing uniformly sized ice cubes.

Still another object of the present invention is to provide a system wherein a large number of ice cube forming molds may be rapidly filled under sanitary conditions.

BRIEF DESCRIPTION OF THE INVENTION

The foregoing objects and other objects which will become more apparent as the description proceeds are achieved by providing apparatus for use in freezing a liquid into a plurality of readily separable volumes wherein the apparatus comprises mold means having walls that define a plurality of separate cavities, passageway means interconnecting adjacent ones of the vacities, pliable package means adapted to sealingly contain the liquid to be frozen with the package means being positioned in the cavities of the mold means and in the passageways of the cavities and means for introducing the liquid to be frozen into the package whereby the package and the liquid therein substantially conform the to the volume of the cavities and the passageway means.

The present invention also contemplates a system using the foregoing apparatus in combination with a reservoir for containing the liquid to be frozen. Filling means adapted to be connected to a source of the liquid are also included as well as conduit means that are in fluid communication with the interior of the reservoir and the means for introducing the liquid into the pliable package means.

DESCRIPTION OF THE DRAWINGS

For a better understanding of the present invention reference should be had to the accompanying drawings wherein like numerals of reference indicate similar parts throughout their respective views and wherein.

DESCRIPTION OF THE PREFERRED EMBODIMENT

Figure 1:
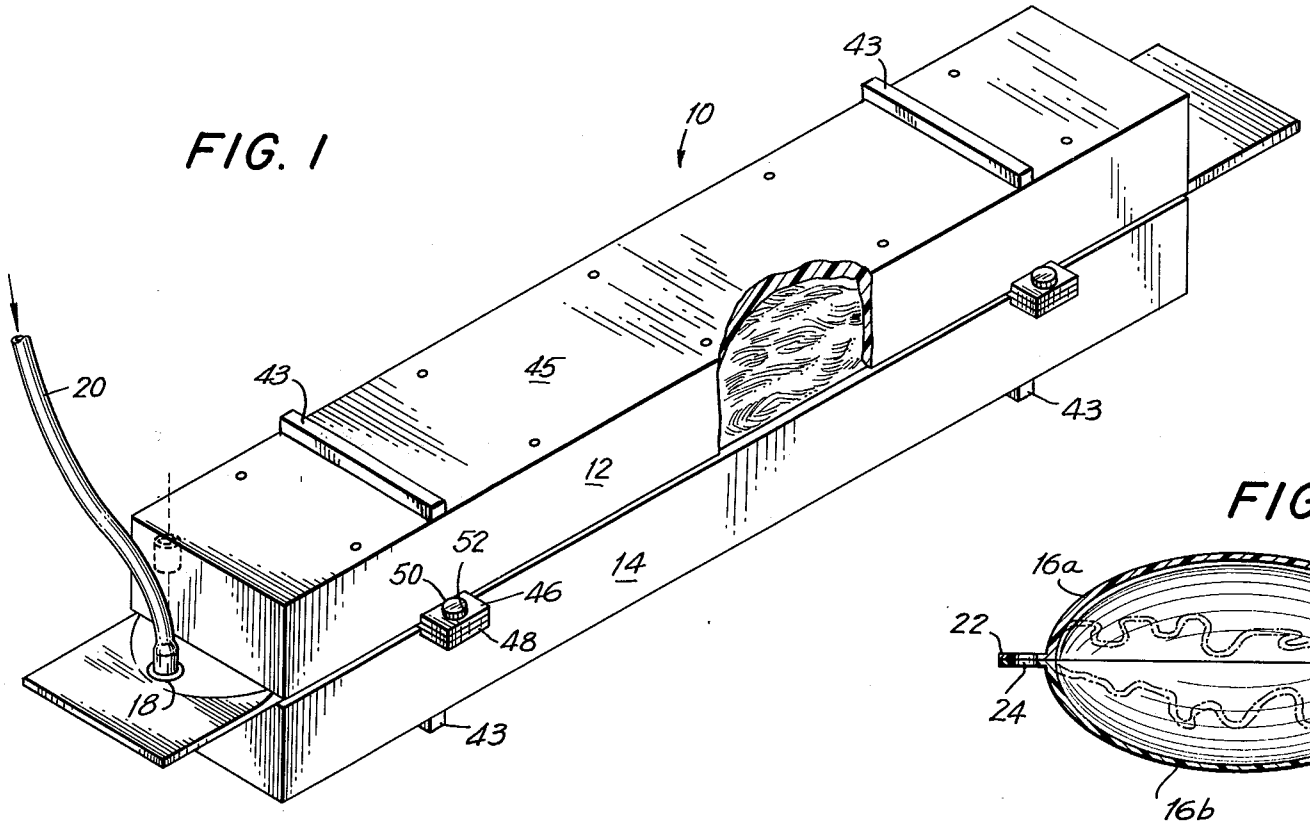
FIG. 1 is a pictorial representation of an improved mold means and pliable package means comprising the present invention.

Referring now to the drawings, and in particular to FIG. 1, there is shown a mold member 10 comprising the present invention. The mold member 10 includes first and second mold sections 12 and 14 and a pliable plastic package 16 sandwiched therebetween. An inlet valve 18 provides means for introducing liquid into the pliable package 16 via a conduit 20.

Figures 2, 4, 5, 6:
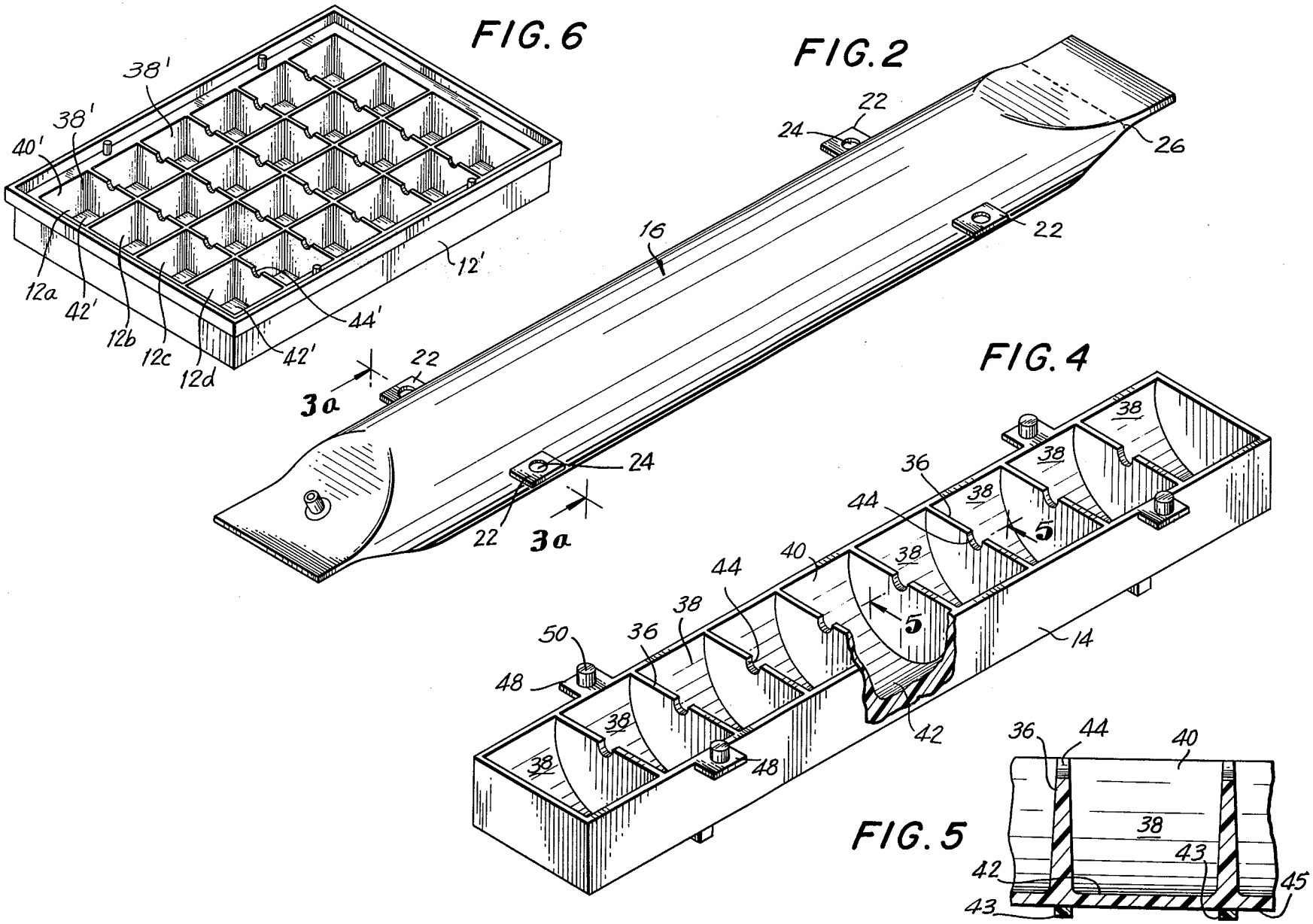
FIG. 2 is a pictorial representation of one embodiment of the pliable package means.
FIG. 4 is a pictorial representation of a typical mold section used with the present invention.
FIG. 5 is a sectional elevational view taken along line 5—5 of FIG. 4.
FIG. 6 is a pictorial representation of another embodiment of the mold means comprising the present invention.

The pliable package 16 is shown best in FIG. 2 wherein it will be seen that there is also provided two layers of plastic sheets 16*a* and 16*b* for example made from polyethylene or other suitable material and two pairs of laterally spaced tabs 22 each of which has an opening 24 formed therein. The package 16 may be formed of any suitable plastic material such as polyethylene, for example. While the package 16 has been illustrated in tubular or rounded form, in actual practice it would be packed flat and free of air. A tear strip schematically represented and designated by the reference character 26 is used for rupturing the package when it is desired to remove the contents thereof.

Figure 3A:
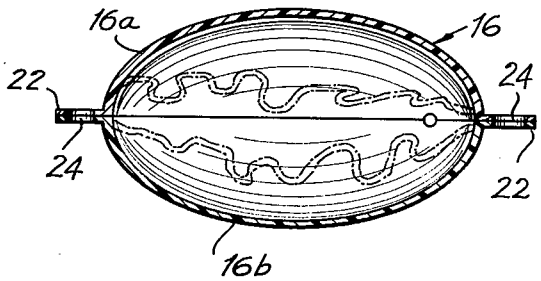
FIG. 3*a* is a transverse sectional view taken along line 3*a*—3*a* of FIG. 2.
Figure 3B:
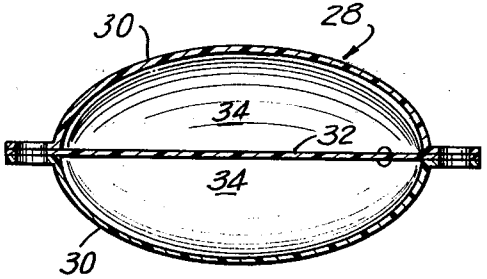
FIG. 3*b* is a transverse sectional view, similar to FIG. 3*a* but illustrating an alternative embodiment of the pliable package means comprising the present invention.

Whereas the package shown in FIG. 2 and FIG. 3*a* is comprised of two plastic layers 16*a* and 16*b* that are heat sealed to each other along the peripheral or marginal edges thereof, the package 28 shown in FIG. 3*b* is comprised of a pair of outer plastic layers 30 and an inner plastic layer 32 that defines two separate compartments 34 whose function will be described subsequently.

Turning now to FIG. 4 there is shown a typical form on one of the mold sections 12 or 14 which essentially are identical. The transverse cross section of the mold 14 is generally U-shaped and is provided with a plurality of axially spaced apart transverse partition walls 36 that define adjacent cavities 38 which include sidewalls 40 and a base wall 42. At the top of each of the partition walls 36 a notch 44 is included. When the two mold sections 12 and 14 are in the position shown in FIG. 1 the opposed notches 44 will define passageways that interconnect adjacent one of the cavities 38. Preferably, as shown in FIG. 5 the partition walls 38 are tapered from top to bottom to permit easy removal of the package with the cubes formed therein. Further, legs 43 are provided on the outer surface 45 of the mold section 12 or 14, so that a space is maintained between stacked molds 10, to permit free air circulation therearound.

The mold sections 12 and 14 are each provided with two pair of laterally extending tabs 46 and 48. In the embodiment illustrated in FIG. 1 for example the tab 48 of the mold section 14 is provided with a pin 50 while the tab 46 of the mold section 12 is provided with an opening 52. Of course, this arrangement can be reversed. In the assembled condition, the pin 50 extends through the opening 24 formed in the tabs 22 of the package 16 as well as through the openings 52 formed in the tabs 46 of the mold section 12. Although not illustrated, other means may be provided for clamping the two mold sections 12 and 14 to each other. Such means may take the form of cap nuts, spring clips or the like. Further, the semi-rigid plastic material from which the mold sections 12 are made to be snap-fitted together may be so constructed as to be capable of being snap-fitted together around the pliable package.

When the fluid is positioned within the pliable package 16 within the mold sections 12 and 14 the natural expansion of the fluid when the same freezes may urge the snap-fitted mold sections to be opened thereby simplifying the removal of the mold sections 12 and 14 from the pliable bag 16 when the cubes have been frozen.

An alternative embodiment of the present invention is shown in FIG. 6. In this alternative embodiment each mold section, for example, mold section 12′, is comprised of units 12*a*, 12*b*, 12*c* and 12*d*, which, by way of example are positioned side-by-side and are suitably secured to each other. It should be evident that a plastic package, for example, of the type designated by the reference character 16, would be provided in an appropriate size. With respect to the plastic package 16 in its unfilled condition, it may take the form of an enfolded structure such that when the package 16 expands into the various cavities 38′ the enfolded package will expand precisely against the wall of each cavity, the folding of the plastic pliable package 16. The form of enfolding of the plastic package will resemble a heavily embossed pattern on the surface of the pliable package to facilitate the expansion of the package 16. Each of the cavities 38′ in each unit would include side walls 40′ and a base wall 42′ as well as a passageway 44′ that interconnects adjacent cavities 38′ in each unit.

Figure 7:
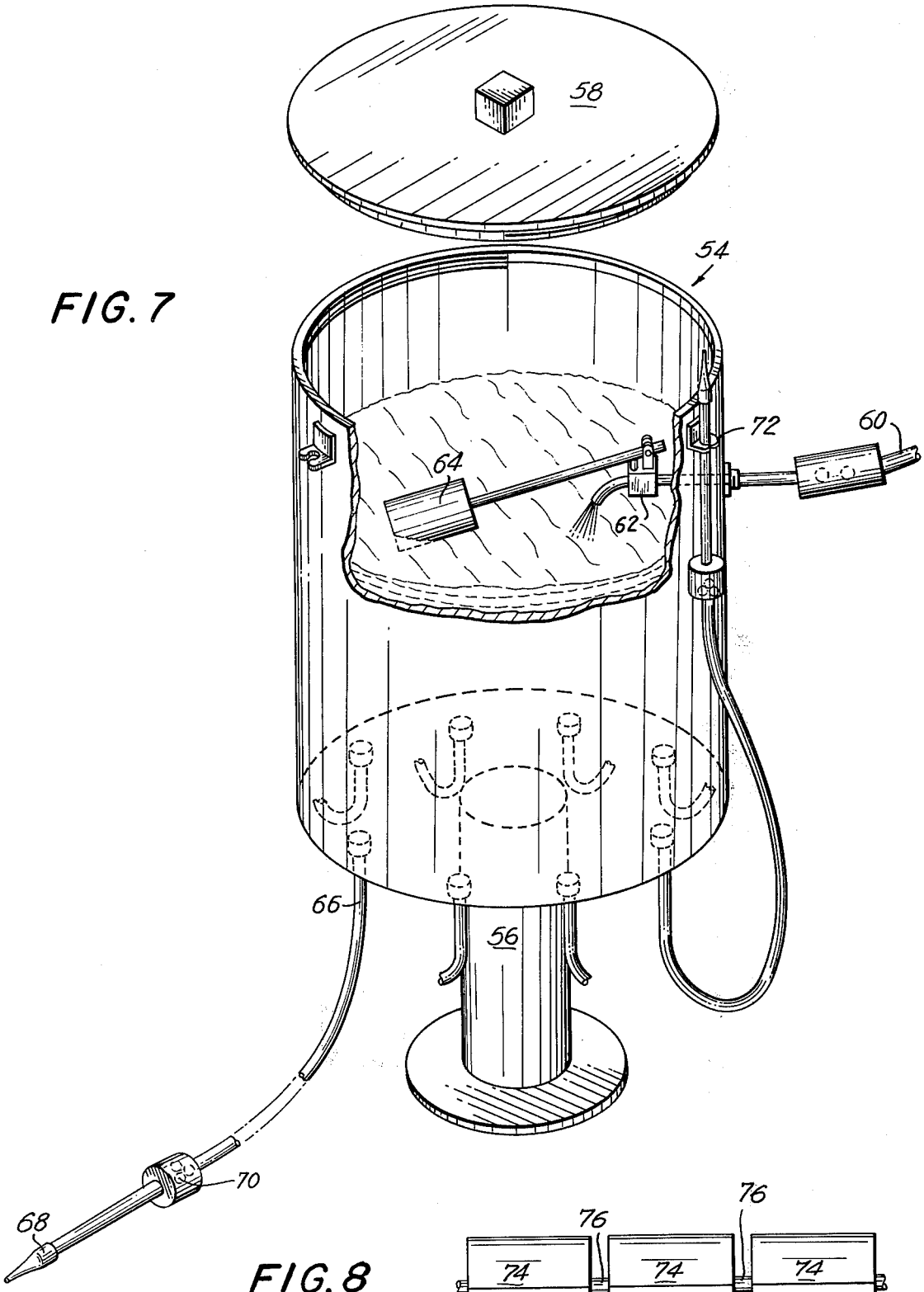
FIG. 7 is a fragmentary, pictorial representation of a portion of a system comprising the present invention.

The system comprising the present invention is fragmentarily illustrated in FIG. 7. A reservoir in the form of a tank 54 is mounted on a pedestal 56 such that is is elevated with respect to a plurality of the mold members 10 and package means 16 that are to be filled so that the water flows from the tank 54 by gravity. Either a removable cover 58 or a permanent closure member is also provided. Conduit 60 is coupled to a water source and is provided at its inner end with a valve 62 that is responsive to the movement of a float 64 so that the level of the water in the tank 54 may be maintained at a predetermined height.

One end of each of a plurality of conduits 66 is in fluid communication with the interior of the tank 54. The other end of each conduit 66 is provided with a nozzle means 68 and is adapted to engage and open the one-way valve 18 formed integrally with the package 16. In the embodiment of FIG. 3*b*, there would be of course two such valves 18, one for each of the compartments 34. Means, such as a plurality of balls 70 positioned within each conduit 66 provide an indication of the cessation of the liquid flow. Clips 72 that are mounted on the outside surface of the tank 54 are used for retaining the conduits 66 when they are not in use. The use of a plurality of conduits 66 may permit fast filling of many mold members 10. Preferably one of the conduits 66 is located at the lowest point of the tank 54 in order to permit complete draining thereof when the water supply is turned off.

With the mold sections 12 and 14 and the pliable package 16 are positioned as shown in FIG. 1 water may be introduced by any suitable means such as the system shown in FIG. 7. The package 16 is oversized in order to allow for the volume of water introduced. That is, the weight of the water will enlarge the package 16 and cause it to conform to the volume of the cavities 38 as well as the passageways defined by the opposed notches 44. As mentioned above, the package 16 is accurately maintained relative to the cavities 38 and the passageways 44 by means of the pins 50 shown in FIG. 1.

Figure 8:
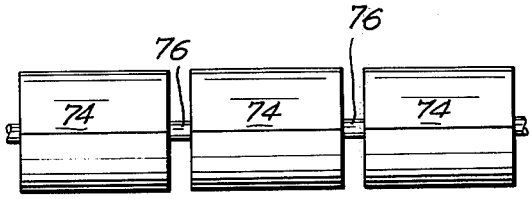
FIG. 8 is a fragmentary elevational view of a typical product formed by the present invention.

One form of the resultant product is shown in FIG. 8. There will be a plurality of cubes 74 which conform generally to the size and shape of the cavities 38. In addition each cube 76 will be connected by a frangible member 76 that results from the size and shape of the passageways defined by the notches 44. It is contemplated that the volume of the connection 76 will be substantially less than the volume of the cubes 74 so that, in use, the connections 76 may easily be broken. It should be clearly understood that the present invention is not limited to the particular shape shown in FIG. 8. That is the cavities 38 may be so designed so as to produce more than one shape of ice cubes and, in fact, any single mold may be designed so as to produce multiple sizes and multiple shapes of ice cubes.

From the foregoing it will be evident that an improved apparatus system for forming ice cubes has been provided. The square or rectangular shape of the mold members can conveniently be used for economy in stacking before and after the ice has been formed. The pliable package may be formed with either one or two compartments but in either event are normally shipped flat and free of air and contamination. The pliable packages are oversized and expansible and dimensionally condensed to permit them to assume the size and shape of the cavities in the mold sections.

An important advantage of the present invention is that a water filled package need never be handled. The only time the package is handled is after the water is frozen. There is no requirement that the ice cube maker, at any time, has to handle a package filled with fluid. It should be further noted that the package when filled with a liquid is always supported as by the mold section 12 and 14. The closed, clean, gravity fed system of the present invention is an advantageous feature. Because of the method used in filling the pliable package of the present invention air pockets in the mold compartment are avoided.

Figure 11:
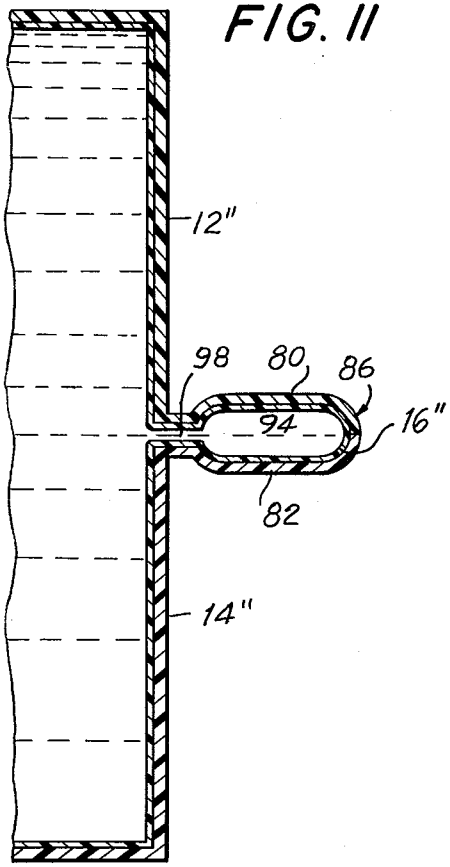
FIG. 11 is a cross sectional view of the alternative embodiment taken along the lines 11—11 of FIG. 9.
Figure 9:
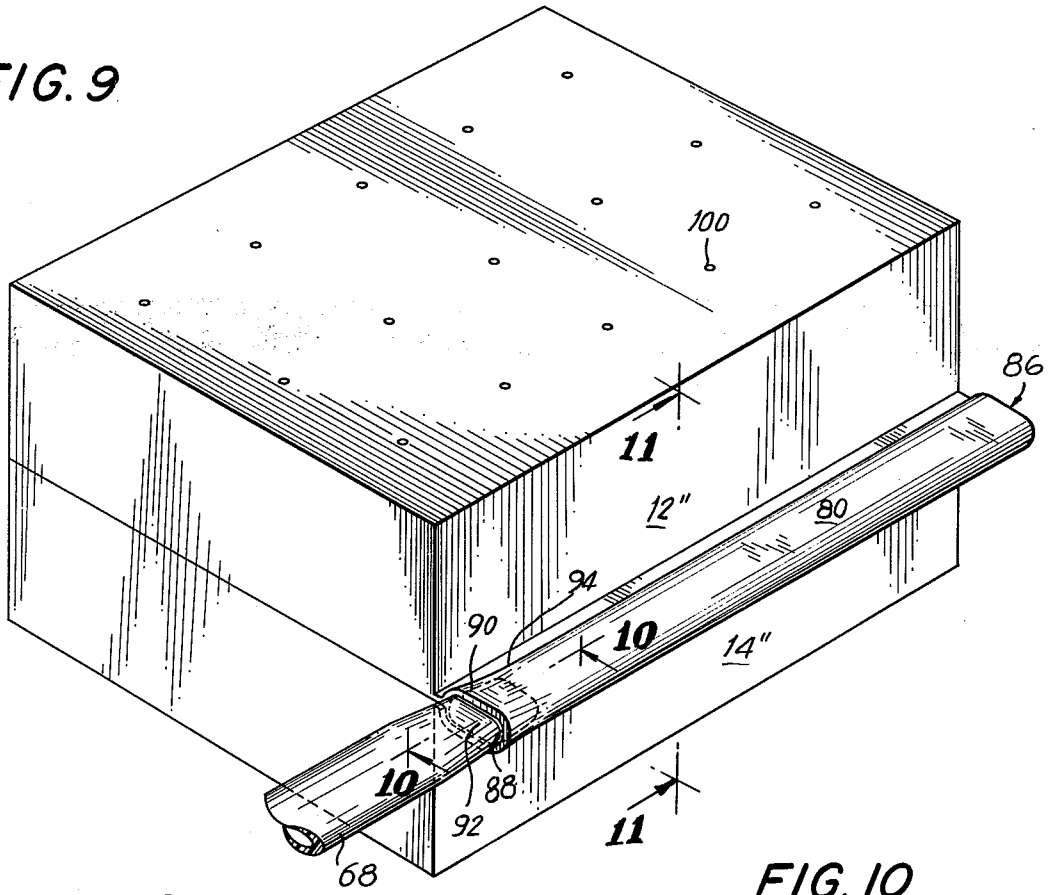
FIG. 9 is a perspective view of an alternative means for filling the pliable package.
Figure 10:
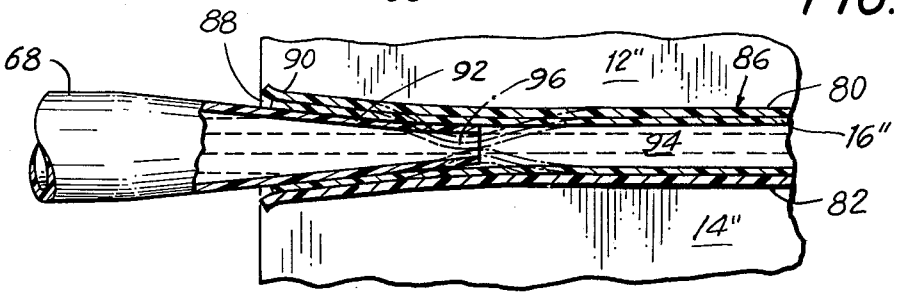
FIG. 10 is a cross sectional of the filling orifice of the alternative filling means of FIG. 9 and taken along lines 10—10 thereof.

The alternative embodiment shown in FIGS. 9, 10 and 11 represents an alternative means of filling the plastic pliable package. The mold sections 12″ and 14″ remain as previously described. The bottom and top mold sections may each be provided with a projecting area which forms a top 80 and bottom 82 of a flat tubular feed member 86 into which water may be injected as a means of filling the plastic package 16″ positioned within the mold sections 12″ and 14″. As shown in FIG. 11 the top and bottom sections of the tubular feed member 86 are integrally molded with the respective top and bottom sections 12″ and 14″ of the mold so that when the mold is closed the flat tubular feed member top and bottom sections are joined together around a part of the plastic package 16″ forming the completed member 86. An opening 88 is provided at one end 90 of the flat tubular member 86 so that water may be injected into the package 16″ which is held in the tubular member 86 by means of a nozzle 68. A constricted area 92 is formed inwardly of the opening 88 and blocks the channel 94 formed by the package 16″ held within the flat tubular member 86. When the nozzle part 68 of a filler tube 66 is urged into the opening 88 the constricted area 96 is urged open so that water may flow down the channel 94 and branch off through side branches 98 into the package 16″ which expands as it is being filled into the various cavities 38 thereby filling the various compartments and thereby forming the ice cubes 74 after they are frozen. It should be noted that when the mold sections are filled the nozzle 68 may be removed from the opening 88 and the constriction is reformed thereby preventing the water from flowing back out through the channel 94 formed in the package 16″ in the flat tubular portion 86 preventing the water from flowing back out the opening.

It should further be noted that when the water freezes within the package 16″ formed by these compartments or various sections of the joined mold, the water will expand thereby snapping the mold open helping in the quick removal of the cubes from the compartments in the mold.

In the case of the preferred and alternative embodiments the mold sections are provided with vent holes 100 to permit the air in the mold to escape while the package 16 expands into the compartments 38.

In order to prevent bubbling from forming within each of the cube forming sections leak holes are provided to permit the escape of trapped air in each of the compartments.

While in accordance with the patent statutes a preferred and alternative embodiment of the present invention has been described in detail, it should be particularly understood that the invention is not limited thereto or thereby.

I claim:

1. An apparatus for use in freezing a liquid into a plurality of readily separable volumes comprising:

a. two cooperative mold sections each having a plurality of separate cavities, respective ones of said cavities being opposed to each other, each cavity including a base wall and a plurality of side walls extending from said base wall;

b. passageway means interconnecting adjacent cavities;

c. a pliable package means to sealingly contain the liquid to be frozen, said mold sections adapted to receive said pliable package means in its unfilled condition therebetween; and d. one way valve means adapted to be coupled to a source of the liquid for introducing the liquid into said pliable package means after said pliable package means has been positioned between said mold sections whereby said pliable package means with said liquid therein expands precisely against said base wall and said side walls and said passageway means so that said pliable package means containing said liquid substantially conforms to the volume of said cavities and said passageway means.

2. The apparatus according to claim 1 wherein said package means comprises three fluid impervious layers sealed to each other for defining two superimposed compartments therein, said one way valve means being in fluid communication with both said compartments whereby both said compartments and the liquid therein are adapted to conform to the volume of said cavities and passageway means in both said mold sections.

3. A system for freezing a liquid into a plurality of readily separable forms comprising:

a. mold means having a plurality of separate cavities, each cavity including a base wall and a plurality of side walls extending from said base wall;

b. passageway means interconnecting adjacent cavities;

c. a pliable package means to sealingly contain the liquid to be frozen, said mold means adapted to receive said pliable package means in its unfilled condition; and d. one way valve means for introducing the liquid to be frozen into said pliable package means after said pliable package means has been positioned in said mold means whereby said pliable package means with said liquid therein expands precisely against said base wall and said side walls and said passageway means so that said pliable package means containing said liquid substantially conforms to the volume of said cavities and said passageway means;

e. a reservoir for containing the liquid to be frozen;

f. means adapted to be connected to a source of liquid for filling said reservoir; and g. conduit means in fluid communication with the interior of said reservoir and adapted to be placed in fluid communication with said one way valve means for introducing the liquid into said pliable package means.

* * * * *